US005615613A

United States Patent [19]

Hattori et al.

[11] Patent Number: 5,615,613

[45] Date of Patent: Apr. 1, 1997

[54] METHOD OF USING A HEMICELLULOSE PRINTING ASSISTANT FOR LITHOGRAPHIC PRINTING PLATES

[75] Inventors: Mitsuo Hattori, Tsukuba-gun; Hitoshi Furuta, Kitasohma-gun; Taro Takahashi, Kitasohma-gun; Hirokazu Maeda, Kitasohma-gun, all of Japan

[73] Assignee: Fuji Oil Co., Ltd., Japan

[21] Appl. No.: 436,590

[22] Filed: May 8, 1995

Related U.S. Application Data

[62] Division of Ser. No. 256,311, filed as PCT/JP93/01535 Oct. 10, 1993, abandoned.

[30] Foreign Application Priority Data

| | | | |
|---|---|---|---|
| Nov. 2, 1992 | [JP] | Japan | 4-317828 |
| Nov. 2, 1992 | [JP] | Japan | 4-317829 |
| May 17, 1993 | [JP] | Japan | 5-114318 |
| Oct. 22, 1993 | [WO] | WIPO | PCT/JP93/01535 |

[51] Int. Cl.[6] ..... B41N 3/08

[52] U.S. Cl. ..... 101/450.1; 101/147

[58] Field of Search ..... 101/450.1, 451, 101/453, 455–459, 460–462, 463.1, 465, 147, 148

[56] References Cited

U.S. PATENT DOCUMENTS

| | | | |
|---|---|---|---|
| 3,559,579 | 2/1971 | Perkins | 101/462 |
| 4,874,423 | 10/1989 | Colegrove et al. | 71/95 |
| 4,874,854 | 10/1989 | Colegrove et al. | 536/114 |

*Primary Examiner*—Stephen R. Funk
*Attorney, Agent, or Firm*—Wallenstein & Wagner, Ltd.

[57] ABSTRACT

A printing assistant comprising a water-soluble hemicellulose as an effective ingredient. It has excellent film formability, long-term storage stability, emulsifiability and desensitization in nonimage areas and further has the effect of improving the emulsion stability and continuous printing stability as a dampening water composition.

11 Claims, No Drawings

METHOD OF USING A HEMICELLULOSE PRINTING ASSISTANT FOR LITHOGRAPHIC PRINTING PLATES

This application is a divisional of application Ser. No. 08/256,311, filed as PCT/JP93/01535, Oct. 22, 1993, now abandoned.

TECHNICAL FIELD

The present invention relates to a printing assistant. More particularly, it is concerned with a printing assistant useful as a printing plate protective agent, a printing plate cleaner, an image eraser, a sensitization protective agent, a gum remover, dampening water for printing, etc.

BACKGROUND ART

Lithography is a printing method which effectively utilizes the property of water and oil in that they essentially do not mix. A printing plate for lithography comprises a water-receptive and oil-base-ink-repellent portion and a water-repellent and oil-base-ink-receptive portion, with the former constituting a nonimage area and the latter constituting an image area.

In general, assistants for a lithographic printing plate, such as printing plate protective agents, printing plate cleaners, image erasers, sensitization protective agents and gum removers, are used in order to protect the nonimage areas. Water-soluble polymers having a film formability have hitherto been used as an indispensable ingredient of the assistant.

For example, in the final step of lithography, a plane protective agent is coated (this procedure being usually referred to as "gumming") for the purpose of protecting the nonimage areas.

The plate protective agent is used in order to maintain the hydrophilicity of the nonimage areas by taking advantage of the film formability and for other purposes such as correction in image areas, such as retouching or elimination, storage in a period between after plate making and before initiation of printing or storage until reuse, prevention of contamination caused by deposition of fingerprints, fats and oils, dust, etc., during handling at the time of mounting the plate in a printing machine, protection against occurrence of flaws and prevention of contamination by oxidation.

In most cases, the conventional plate protective agent comprises a solution of a water-soluble polymer, such as gum arabic, cellulose gum or a polymer having a carboxyl group in its molecule and optional additives, such as pH adjustors and preservatives.

In the plate protective agent, when gum arabic, which is a naturally occurring plant gum substance, is used as the water-soluble polymer, it exhibits an excellent film formability.

On the other hand, as well known in the art, in the production of a photosensitive lithographic printing plate, removal of an unnecessary image, that is, the so-called "image erasing," is carried out subsequent to the step of forming an image. In particular, in a positive-working lithographic printing plate, unnecessary images are likely to occur due to traces of an image of an original film and foreign matter such as contaminants, which renders the image erasing indispensable.

In the image erasing of the lithographic printing plate, in addition to removal of unnecessary images, the surface of the substrate at its portions where the images have been removed should be rendered hydrophilic so that these portions do not receive the ink during printing. However, useful image erasing techniques, which can satisfy the above requirements, are very few.

Examples of a useful image erasing technique include a technique where the unnecessary images are physically rubbed out with a stone rod, a technique where the images and the substrate are subjected to etching with a strong alkaline solution to remove the unnecessary images and a technique where a solution containing an organic solvent capable of dissolving an image and an acidic substance, such as hydrofluoric acid, is used to dissolve unnecessary images and, at the same time, to etch the substrate to impart hydrophilicity to the substrate in its nonimage areas. Although these techniques are useful, the former method has drawbacks including the fact that a large area cannot be treated and contamination occurs during printing. On the other hand, the two latter methods have several drawbacks including the fact that necessary images in their fine portions are damaged, harmfulness to human body and skin is high and there occurs a problem of waste water treatment. For this reason, the above techniques are not always satisfactory.

in recent years, use of an image eraser comprising a water-soluble polymer, an organic solvent, a surfactant and a mineral acid has been exclusively adopted as a method useful for reducing the above drawbacks. In the method wherein such an image eraser is used, when gum arabic, which is a naturally occurring plant gum substance, is used as the water-soluble polymer, it exhibits an excellent film formability.

Further, as described above, also when gum arabic is used as the water-soluble polymer used in a plate cleaner for protecting nonimage areas, a sensitization protective agent or a gum remover, it exhibits an excellent film formability.

Further, in lithography, dampening water for lithography is used. The dampening water for lithography wets nonimage areas to increase the interfacial chemical difference between the image area and the nonimage area, thereby enhancing the ink repellency of the nonimage area and the ink receptivity of the image area.

Also in the dampening water for lithography, a water-soluble polymer having a film formability is used as an indispensable ingredient. In this case, when gum arabic, which is a naturally occurring plant gum substance, is used as the water-soluble polymer, it exhibits an excellent film formability as dampening water for lithography.

As described above, gum arabic, which has hitherto been used as a water-soluble polymer in assistants for lithography, exhibits an excellent suitability for all the assistants. However, the supply thereof is susceptible to weather in production countries, so that the price fluctuation is large. For this reason, in recent years, naturally occurring gum substances, which can be stably supplied, have become strongly desired in the art.

It is noted that chemically modified starch or the like has been developed as an alternative to the gum arabic. It, however, has a poor capability of desensitizing the nonimage area, so that it is not always satisfactory.

DISCLOSURE OF THE INVENTION

An object of the present invention is to provide a printing assistant which exhibits a stable film formability for a long period of time, is inexpensive and can be stably supplied.

Under the above circumstances, the present inventors have made extensive and intensive studies and, as a result, have found that use of a water-soluble hemicellulose, particularly a water-soluble hemicellulose derived from beans, as a water-soluble polymer component in an assistant for lithography can provide an assistant for lithography which has a high film formability. The present invention has been completed based on this finding.

Accordingly, the present invention provides a printing assistant comprising a water-soluble hemicellulose as an effective ingredient.

BEST MODE FOR CARRYING OUT THE INVENTION

In the present invention, the water-soluble hemicellulose is preferably derived from beans, particularly soybeans, among others derived from seed leaves thereof.

Although the water-soluble hemicellulose may have any molecular weight, the average molecular weight is preferably in the range of from several tens of thousands to several millions, specifically in the range of from 50,000 to one million. The average molecular weight of the water-soluble hemicellulose is a value determined by the limiting viscosity method wherein the viscosity is measured in a 0.1M $NaNO_3$ solution using a standard Pullulan (manufactured by Showa Denko K.K.) as a standard substance. Uronic acid was measured by the Blumenkrantz method, and neutral sugars were measured by GLC (gas-liquid chromatography) after alditol acetylation.

The water-soluble hemicellulose can be produced by extracting the water-soluble hemicellulose from a raw material containing hemicelluloses with water or in some cases, by heat-eluting the hemicellulose therefrom under acidic or alkaline conditions or decomposition-eluting the hemicellulose therefrom with an enzyme. An embodiment of the above-described process for producing the water-soluble hemicellulose will now be described.

Husks of oily seeds, for example, soybeans, palm, coconut, corn and cottonseeds, usually obtained by removing fats and oils and proteins therefrom, or vegetable matter, such as residues of grains, for example, rice and wheat, usually obtained by removing starch therefrom. If soybeans are used as the raw material, bean curd residue iokara) produced as a by-product in the production of a bean curd, a soybean milk or a separated soybean protein may be utilized as the raw material.

The above-described raw material is heat-decomposed under acidic or alkaline conditions, preferably in a pH region around the isoelectric point of each protein, preferably at 80° to 130° C., still preferably 100° to 130° C., to fractionate a water-soluble fraction which is then dried as it is or alternatively subjected to, for example, an activated carbon treatment, a resin adsorption treatment or an ethanol precipitation treatment to remove hydrophobic substances or low-molecular substances and dried to provide a water-soluble hemicellulose.

When the above water-soluble hemicellulose is used as the water-soluble polymer, which is the raw material for the assistant for a lithographic printing plate and the dampening water for lithography, more stable film formation can be attained as compared with use of gum arabic or modified starch. When the assistant for a lithographic printing plate is in an emulsion form, use of the water-soluble hemicellulose can provide products having a better emulsifiability than use of gum arabic or chemically modified starch.

In the present invention, the water-soluble hemicellulose, as such, can be used as the water-soluble polymer. However, use thereof in combination with conventional water-soluble polymers can compensate for the drawbacks of the conventional water-soluble polymers.

Examples of conventional naturally occurring water-soluble polymers include gum arabic, tragacanth gum, carageenan, xanthan gum, gelatin, casein sodium, guar gum, gum tare, glue plants (*funori*), agar, furcellaran, tamarind seed polysaccharides, gumkaraya, hibiscus, pectin, sodium alginate, pullulan, jellan gum locust bean gum, albumin such as whey and various starches.

Examples of semi-synthetic water-soluble polymers include carboxymethyl cellulose (CMC), methyl cellulose (MC), ethyl cellulose (EC), hydroxyethyl cellulose (HEC), alginic acid propylene glycol ester and chemically modified starches including soluble starches.

Examples of conventional synthetic water-soluble polymers include polyethylene glycol and copolymers thereof, polyvinyl alcohol and copolymers thereof, polyvinyl pyrrolidone, polyacrylamide and copolymers thereof, polyacrylic acid and copolymers thereof, vinyl methyl ether/maleic anhydride copolymer, vinyl acetate/maleic anhydride copolymer and polystyrenesulfonic acid and copolymers thereof.

In some cases, the effect of the water-soluble hemicellulose according to the present invention is further improved by using the water-soluble hemicellulose in combination with at least one member selected from the above-described various water-soluble polymers. In this case, the water-soluble hemicellulose can compensate for the drawbacks of the various water-soluble polymers.

When the water-soluble hemicellulose according to the present invention is used as a plate protective agent for a lithographic printing plate, the amount thereof used is preferably in the range of from 0.1 to 35% by weight, still preferably in the range of from 0.3 to 25% by weight, based on the total weight of the plate protective agent.

In general, the plate protective agent is advantageously used in an acidic region, that is, in a pH range of from 3 to 6. In order to adjust the pH value of the plate protective agent to 3 to 6, it is suitable to use a mineral acid, an organic acid, an inorganic salt or the like in the protective agent.

Preferred examples of the mineral acid include sulfuric acid, nitric acid, phosphoric acid and metaphosphoric acid, and lacetic acid, citric acid, oxalic acid, malonic acid, p-toluenesulfonic acid, tartaric acid, malic acid, lactic acid, levulinic acid, organic sulfonic acid, ascorbic acid, gluconic acid, hydroxyacetic acid, sulfanilic acid, phytic acid, etc. are useful as the organic acid. Further, alkali metal salts, alkaline earth metal salts and ammonium salt of these mineral acids and organic acids may be favorably used. The mineral acids, organic acids and their salts and the like may be used alone or in a combination of two or more of them.

Further, surfactants may be added to the plate protective agent of the present invention for the purpose of improving the surface state of the coating.

Examples of the surfactants usable in the present invention include anionic surfactants and nonionic surfactants. Examples of the anionic surfactant include salts of aliphatic alcohol sulfates, salts of aliphatic alcohol phosphates, salts of dibasic fatty acid ester sulfonates, salts of fatty acid amide sulfonates, salts of alkylaryl sulfonates and salts of naphthalene sulfonate condensed with formaldehyde, and examples of the nonionic surfactant include polyethylene glycol alkyl ethers, polyethylene glycol alkyl esters, sorbitan alkyl esters and polyoxypropylene polyoxyethylene ethers. The surfactants may be used in a combination of two or more of them. Although the amount of the surfactant added is not particularly limited, it is preferably in the range of from 0.01 to 10% by weight based on the plate protective agent.

In addition to the above ingredients, wetting agents, preservatives, etc., may be added according to need. Lower polyhydric alcohols, such as glycerin, ethylene glycol and triethylene glycol, may be used as the wetting agent. The amount of the wetting agent added is preferably in the range of from 0.1 to 5% by weight, still preferably in the range of from 0.5 to 3% by weight, based on the plate protective agent. Benzoic acid and derivatives thereof, phenol, formalin and sodium dehydroacetate may be added as the preservative in an amount in the range of from 0.005 to 2% by weight based on the plate protective agent.

The plate protective agent of the present invention may be used for various lithographic printing plates. In particular, it can be suitably used for lithographic printing plates formed by subjecting a photosensitive lithographic printing plate (PS plate) comprising an aluminum plate as a substrate and, provided thereon, a photosensitive layer to imagewise exposure and then development.

When the water-soluble hemicellulose according to the present invention is used in an image eraser for a lithographic printing plate, the content of the water-soluble polymer in the image eraser is preferably in the range of from 0.1 to 5% by weight, still preferably in the range of from 0.5 to 3% by weight.

The organic solvent used in the image eraser of the present invention serves to dissolve or swell the photosensitive layer to which the eraser is applied, and examples of the organic solvent include ketones, such as acetone, methyl ethyl ketone, methyl isopropyl ketone, diisobutyl ketone and cyclohexanone, hydrocarbons, such as benzene, toluene and xylene, ethers, such as methyl glycol, ethyl glycol and butyl glycol, esters, such as methyl glycol acetate and ethyl glycol acetate, aromatic alcohols, such as propyl alcohol, butyl alcohol, benzyl alcohol and ethylene glycol, and other organic solvents, such as dimethylformamide and butyrolactone. They may be used alone or in the form of a mixture of two or more of them.

Among the above-described organic solvents, dimethylformamide, cyclohexanone, xylene, ethyl glycol acetate, etc., are preferred.

The content of the organic solvent in the image eraser is in the range of from 50 to 90% by weight, still preferably in the range of from 60 to 80% by weight.

Examples of surfactants usable in the present invention include known nonionic surfactants, anionic surfactants, cationic surfactants and amphoteric surfactants. Among them, those which can be dissolved or dispersed in the organic solvent used can be selected and used.

Particularly preferred are nonionic surfactants, and examples thereof include polyoxyethylene alkyl ethers, polyoxyethylene alkylallyl ethers, polyoxyethylene alkyl esters, polyoxyethylene sorbitan alkyl esters and polyoxyethylene/polyoxypropylene copolymers. The. surfactants may be used alone or in a combination of two or more of them. The content of the surfactant in the image eraser is suitably in the range of from 3 to 20% by weight, preferably in the range of from 5 to 15% by weight.

In general, the image eraser is advantageously used in an acidic region, that is, a pH range of from 3 to 6. In order to adjust the pH value of the image eraser to 3 to 6, it is suitable to use a mineral acid, an organic acid, an inorganic salt or the like in the image eraser.

The above-described various acids and salts are suitably those exemplified above in connection with pH adjustment in the plate protective agent. Besides the above-described ingredients, dyes, thickening agents, preservatives, etc., may be added according to need.

The image eraser of the present invention can be easily prepared by mixing the above various ingredients together. The object in using the image eraser can be easily attained by soaking a brush with the image eraser thus prepared, coating the image eraser in this state on the image in its portion to be erased and then conducting washing with water. Further, recontamination of the erased image portion during printing can also be eliminated.

The lithographic printing plate treated with the image eraser of the present invention can be coated with a plate protective agent, that is, subjected to a gumming treatment, to ensure a good storage stability after the treatment.

The image eraser of the present invention may be used for both negative-working and positive-working lithographic printing plates. It can be particularly favorably used for the positive-working lithographic printing plate.

When the water-soluble hemicellulose according to the present invention is used in the dampening water composition for lithographic printing, the amount thereof used is preferably in the range of from 0.001 to 10% by weight, still preferably in the range of from 0.005 to 1% by weight, based on the total weight of the dampening water composition.

Mineral acids, organic acids or their salts may be used as the pH buffering substance contained in the dampening water composition of the present invention. These compounds are effective in pH adjustment and pH buffering of the dampening water composition and etching to a suitable extent and prevention of corrosion of the substrate of the lithographic printing plate.

The amount of the pH buffering substance added is preferably in the range of from 0.001 to 1% by weight, and the pH buffering substance is preferably used on the acid side of neutrality in a pH range of from 3 to 7. However, the pH buffering substance may contain an alkali metal oxide, an alkali metal phosphate, an alkali metal carbonate or a silicate and be used the alkali side of neutrality in a pH range of from 7 to 11.

Further, if necessary, the dampening water composition of the present invention may further comprise a solvent, a wetting agent, a preservative, an anti-foaming agent, etc.

Specific examples of the wetting agent include polyols, glycol ethers, alcohols and surfactants. Examples of the polyol and glycol ether include 2-ethyl-1,3-hexanediol, hexyl carbitol, ethylene glycol, diethylene glycol, triethylene glycol, propylene glycol, dipropylene glycol, tripropylene glycol, hexylene glycol, tetraethylene glycol, 1,5-pentanediol, hexyl cellosolve, glycerin, diglycerin, ethylene glycol monomethyl ether, diethylene glycol monomethyl ether, triethylene glycol monomethyl ether, polyethylene glycol monomethyl ether, propylene glycol monomethyl ether, dipropylene glycol, monomethyl ether, ethylene glycolmonopropyl ether, diethylene glycol monopropyl ether, propylene glycol monopropyl ether, dipropylene glycol monopropyl ether, ethylene glycol monoisopropyl ether, diethylene glycol monoisopropyl ether, ethylene glycol monobutyl ether, diethylene glycol monobutyl ether, triethylene glycol monobutyl ether, propylene glycol monobutyl ether, dipropylene glycol monobutyl ether, polypropylene glycol (molecular weight: 200 to 10000), ethylene glycol monoisobutyl ether, diethylene glycol monoisobutyl ether, ethylene glycol monoallyl ether, ethylene glycol monophenyl ether, diethylene glycol monophenyl ether, ethylene oxide adduct of 2-ethyl-1,3-hexanediol, acetylene glycol and ethylene oxide adduct thereof.

Examples of the alcohol include ethyl alcohol, n-propyl alcohol, isopropyl alcohol, n-butyl alcohol, isobutyl alcohol, n-amyl alcohol and benzyl alcohol.

Examples of the surfactant include anionic surfactants, nonionic surfactants and cationic surfactants.

Examples of the anionic surfactant include salts of fatty acids, salts of abletic acid, salts of alkanesulfonic acids, salts of hydroxyalkanesulfonic acids, salts of dialkylsulfosuccinic acids, salts of straight-chain alkylbenzenesulfonic acids, salts of branched alkylbenzenesulfonic acids, salts of alkylnaphthalenesulfonic acids, salts of alkylphenoxypolyoxyethylenepropylsulfonic acids, salts of polyoxyethylene alkylsulfophenyl ethers, sodium salt of N-methyl-N-oleyltaurine, disodium salt of N-alkylsulfosuccinic acid monoamides, salts of petroleum sulfonic acids, sulfated castor oil, sulfated beef tallow, salts of sulfates of fatty acid alkyl esters, salts of alkyl sulfates, salts of sulfates of polyoxyethylene alkyl ethers, salts of fatty acid monoglyceride sulfates, salts of sulfates of polyoxyethylene alkylphenyl ethers, salts of sulfates of polyoxyethylene styrylphenyl ether, salts of alkylphosphoric acids, salts of phosphates of polyoxyethylene alkyl ethers, salts of phosphates of polyoxyethylene alkylphenyl ethers, partial saponification products of styrene/maleic anhydride copolymer, partial saponification products of olefin/maleic anhydride copolymers and condensates of salts of naphthalenesulfonic acid with formalin. Among them, salts of dialkylsulfosuccinic acids, salts of alkyl sulfates and salts of alkylnaphthalenesulfonic acids are particularly preferred.

Examples of the nonionic surfactant include polyoxyethylene alkyl ethers, polyoxyethylene alkylphenyl ethers, polyoxyethylene polystyrylphenyl ether, polyoxyethylene polyoxypropylene alkyl ether, partial esters of glycerin with fatty acids, partial esters of sorbitan with fatty acids, partial esters of pentaerythritol with fatty acids, esters of propylene glycol with monofatty acids, partial esters of sucrose with fatty acids, partial esters of polyoxyethylene sorbitan with fatty acids, partial esters of polyoxyethylene sorbitol with fatty acids, esters of polyoxyethylene glycol with fatty acids, partial esters of polyglycerin with fatty acids, polyoxyethylenated castor oil, partial esters of polyoxyethylene glycerin with fatty acids, fatty acid diethanolamides, N,N-bis-2-hydroxyalkylamines, polyoxyethylenealkylamines, esters of triethanolamine with fatty acids and trialkylamine oxides. Among them, polyoxyetylene alkylphenyl ethers, polyoxylpropylene block polymers, etc., are particularly preferred.

Examples of the anionic surfactants include alkylamine salts, quaternary ammonium salts, polyoxyethylene alkylamine salts and polyethylene polyamine derivatives.

These wetting agents may be used alone or in a combination of two or more of them, and the amount thereof used is preferably in the range of from 0.03 to 5% by weight, still preferably in the range of from 0.05 to 3% by weight, based on the total weight of the dampening water composition.

Specific examples of the preservative usable in the present invention include phenol and derivatives thereof, imidazole derivatives, formalin, sodium dehydroacetate, 4-isothiazolin-3-one derivatives, benzotriazole derivatives, amidine guanidine derivatives, quaternary ammonium salts, derivatives of pyridine, guinoline and guanidine, diazine, triazole derivatives, oxazole and oxazine derivatives.

The preservative is added in such an amount as to effectively exhibit the effect against bacteria, fungi, yeast, etc., and although the amount thereof used varies depending upon the kinds of microorganisms, such as bacteria, fungi and yeast, it is preferably in the range of from 0.001 to 1% by weight based on the total weight of the dampening water composition used. In this case, it is preferred to use at least two preservatives in combination so that the effect can be attained against various microorganisms, such as bacteria, fungi and yeast.

The anti-foaming agent usable in the present invention may be any one so far as it can exhibit the anti-foaming effect. However, silicone compounds are preferred. The silicone compounds are classified into emulsion type and one-pack type. Both types can exhibit the intended effect in a small amount, and the amount of the anti-foaming agent used is preferably in the range of from 0.001 to 0.3% by weight based on the total weight of the dampening water composition used.

Besides the above-described compounds, if necessary, chelate compounds may be added to the dampening water composition of the present invention. The purpose of adding the chelate compound is to eliminate a problem that calcium and other ions contained in tap water, well water and other water used for dilution in using the dampening water composition have an adverse effect on printing.

In this case, any chelate compound may be favorably used so long as it can stably exist in the dampening water composition and is not detrimental to the printing property. Specific examples of the chelate compound include organic phosphonic acids or phosphonoalkanetricarboxylic acids, such as ethylenediaminetetraacetic acid, potassium salt of ethylenediaminetetraacetic acid, sodium salt of ethylenediaminetetraacetic acid, diethylenetriaminepentaacetic acid, potassium salt of diethylenetriaminepentaacetic acid, sodium salt of diethylenetriaminepentaacetic acid, triethylenetetraminehexaacetic acid, potassium salt of triethylenetetraminehexaacetic acid, sodium salt of triethylenetetraminehexaacetic acid, hydroxyethylethyienediaminetriacetic acid, potassium salt of hydroxyethylethylenediaminetriacetic acid, sodium salt of hydroxyethylethylenediaminetriacetic acid, nitrilotriacetic acid, sodium salt of nitrilotriacetic acid, 1-hydroxyethane-1,1-diphosphonic acid, potassium salt of 1-hydroxyethane-1,1-diphosphonic acid, sodium salt of 1-hydroxyethane-1,1-diphosphonic acid, aminotri(methylenephosphonic acid), potassium salt of aminotri(methylenephosphonic acid) and sodium salt of aminotri(methylenephosphonic acid). Further, it is also possible to use organic amine salts of the chelate compounds instead of the potassium salt and sodium salt of the chelate compounds.

The amount of the chelate compounds added is preferably in the range of from 0.001 to 5% by weight, still preferably in the range of from 0.005 to 1% by weight, based on the total weight of the dampening water composition used.

The dampening water composition of the present invention may further comprise various additives, which can stably exist in the dampening water composition and are not detrimental to the printing property, such as various colorants, rust-preventives and agents for preventing oxidative staining in nonimage areas.

Colorants, which can be suitably used in the present invention, include food dyes. Specific examples thereof include yellow dyes, such as C.I. Nos. 19140 and 15985, red dyes, such as C.I. Nos. 16185, 45430, 16255, 45380 and 45100, blue dyes, such as C.I. Nos. 42090 and 73015, and green dyes, such as C.I. No. 42095.

Examples of the rust preventive, which can be suitably used in the present invention, include benzotriazole, tolyltriazole, benzoimidazole and 2-mercaptobenzoimidazole.

The agents for preventing oxidative staining in nonimage areas, which can be suitably used in the present invention, include zinc nitrate, magnesium nitrate and sodium nitrate.

Also from the viewpoint of profitability, it is preferred that the dampening water composition of the present invention be produced as a concentrated solution and diluted 10- to 1000-fold with tap water, well water or the like prior to use.

Examples of the lithographic printing plate, for which the dampening water composition of the present invention can be used, include various lithographic printing plates, such as photosensitive lithographic printing plates (PS plates), deep-etch plates, multi-layer metallic plates, such as bimetal and trimetal plates, direct drawing masters and lithographic printing plates for electrophotography.

Embodiments of the present invention will now be described with reference to the following examples which are presented for illustrative purposes only and are not intended to limit the spirit and scope of the invention. In the following examples, all "parts" and "%" are by weight.

Preparation of Soybean Hemicellulose

To raw bean curd residue (okara) obtained in the process of manufacturing a separated soybean protein was added water in an amount of twice the amount of the raw bean curd residue. The mixture was adjusted to pH 4.5 with hydrochloric acid and hydrolyzed at 120° C. for 1.5 hr. The reaction mixture was cooled and centrifuged (10000 G×30 min) to separate it into a supernatant and a precipitate. The collected precipitate was further washed with an equal weight of water and centrifuged, and the resultant supernatant was combined with the above supernatant, applied to an activated carbon column and dried to provide water-soluble hemicellulose (a).

Moreover, the water, soluble hemicellulose was dissolved in 0.5% saline, and reprecipitation was repeated three times in such a manner that the ethanol concentration became 50%, followed by desalting with an ion-exchange resin ("Amberlite IR-120 B" manufactured by Organo Corp.) to provide water-soluble hemicellulose (b).

Water-soluble hemicellulose (c) was provided as described above, except that the treatment using an activated carbon column was not effected.

The results are summarized as follows.

| | Composition (%) | | |
|---|---|---|---|
| Ingredients | (a) | (b) | (c) |
| Water | 5.71 | 7.75 | 5.10 |
| Crude protein | 1.93 | 1.03 | 5.43 |
| Crude ash | 5.29 | 0.22 | 5.30 |
| Polysaccharides | 87.07 | 91.00 | 84.17 |
| Average molecular weight | 178,000 | 207,000 | 114,000 |

Then, the sugar composition of the water-soluble hemicelluloses (a), (b) and (c) was analyzed by the following method. Uronic acid was measured by the Blumenkrantz method, and neutral sugars were measured by the alditol acetate method using GLC.

The results were as follows.

| Sugar Composition (wt. %) | | | |
|---|---|---|---|
| Type of sugar | (a) | (b) | (c) |
| Uronic acid | 20.4 | 16.9 | 19.4 |
| Rhamnose | 1.6 | 2.7 | 2.1 |
| Fucose | 2.7 | 5.2 | 3.9 |
| Arabinose | 19.9 | 19.2 | 23.1 |
| Xylose | 6.4 | 8.4 | 5.8 |
| Galactose | 47.3 | 46.8 | 43.4 |
| Glucose | 1.8 | 0.9 | 2.3 |

| Example 1 | |
|---|---|
| Water-soluble soybean hemicellulose (a) | 10.0 parts |
| 40% Aqueous solution of anionic surfactant* | 0.5 part |
| Sodium dehydroacetate | 0.1 part |
| Phosphoric acid (85%) | 0.3 part |
| Pure water | 89.1 parts |

*Sodium alkyl diphenylether disulfonate (manufactured by Sanyo Chemical Industries, Ltd.)

The above-described ingredients were homogeneously mixed together to provide a plate protective agent for a lithographic printing plate.

EXAMPLE 2

A printing plate protective agent was prepared in quite the same manner as that of Example 1, except that water-soluble soybean hemicellulose (b) was used instead of water-soluble soybean hemicellulose (a).

EXAMPLE 3

A printing plate protective agent was prepared in quite the same manner as that of Example 1, except that water-soluble soybean hemicellulose (c) was used instead of water-soluble soybean hemicellulose (a).

COMPARATIVE EXAMPLE 1

A printing plate protective agent was prepared in quite the same manner as that of Example 1, except that gum arabic was used instead of water-soluble soybean hemicellulose (a).

COMPARATIVE EXAMPLE 2

A printing plate protective agent was prepared in quite the same manner as that of Comparative Example 1, except that dextrin was used instead of gum arabic.

A photosensitive lithographic printing plate was prepared for the purpose of evaluating the effect of the printing plate protective agents provided in the above Examples and Comparative Examples.

Specifically, a 0.241 mm-thick aluminum plate was immersed in a 7% aqueous solution of sodium tertiary phosphate at 60° C. to effect degreasing, washed with water and grained by brushing the aluminum plate with a nylon brush while running a solution of pumice suspended in water. After washing with water, the grained aluminum plate was immersed for 30 to 60 sec in a 5% aqueous solution of potassium silicate ($SiO_2/K_2O$ molar ratio: 2.0) kept at 70° C., thoroughly washed with water and then dried.

A sensitizing solution comprising 6.2 parts of 2-hydroxyethyl methacrylate copolymer (as synthesized by the process described in Example 1 of British Patent No. 1505739), 0.4 part of 2-methoxy-4-hydroxy-5-benzoylbenzenesulfonate of a condensate of p-diazodiphenylamine with paraformaldehyde, 0.1 part of Oil Blue #603 (manufactured by Orient Chemical Industries, Ltd.), 46.7 parts of 2-methoxyethanol, 31.1 parts of methanol and 15.5 parts of ethylene chloride was coated on the above-described aluminum substrate at a weight coverage on a dry basis of 1.8 g/m$^2$ to provide a photosensitive lithographic printing plate.

The resultant printing plate was exposed using a halftone negative film and developed with an aqueous developing solution comprising 0.3 part of sodium sulfite, 2.8 parts of benzyl alcohol, 1.9 parts of triethanolamine, 0.5 part of: monoethanolamine, 1.0 part of sodium t-butylnaphthalenesulfonate and 93.5 parts of pure water, washed with water and dried.

The printing plate was then divided into six separate plates. Among the six plates, five plates were coated with the plate protective agents prepared in the above examples and comparative examples, and excessive protective agents were wiped off with a cloth. The remaining one plate was not coated with any plate protective agent.

These samples were held in a thermo-hygrostat at a temperature of 45° C. and a humidity of 85% for 3 days, and printing was carried out according to the conventional method using a Heiderlerg KOR-D printing machine to determine the number of failed prints necessary to provide a sharp print and to observe staining during printing.

The results are summarized below.

| | Number of failed prints necessary to provide sharp print | Staining* |
|---|---|---|
| Ex. 1 | 12 | ○ |
| Ex. 2 | 18 | ○ |
| Ex. 3 | 15 | ○ |
| Comp. Ex. 1 | 36 | ○ |
| Comp. Ex. 2 | 55 | Δ |
| Printing plate protective agent not used | 10 | X |

*○ : Not Stained, Δ: Somewhat stained, X: Stained significantly

As described above, the lithographic printing plate protective agents using the water-soluble soybean hemicellulose were excellent in both sensitization in image areas and desensitization in nonimage areas.

Thus, the lithographic printing plate protective agent using a water-soluble hemicellulose as a water-soluble polymer can be easily applied onto a plate using a sponge, a cotton tampon, an automatic gum coater, etc., is excellent in both sensitization in image areas and desensitization in nonimage areas and can be easily removed even after storage for a long period of time by washing with water or contact with a dampening roller. Further, since the hydrophilicity in the nonimage areas and the lipophilicity in the image areas can be held, there is no possibility that the lithographic printing plate treated with the lithographic printing plate protective agent will cause printing dropout.

EXAMPLE 4

| Solution A | |
|---|---|
| 5% Aqueous solution of water-soluble soybean hemicellulose (a) | 61.70 parts |
| Sulfamic acid | 3.00 parts |
| 85% Phosphoric acid | 1.00 part |
| Noigen ET-120 (polyethylene glycol oleyl ether manufactured by Dai-Ichi Koyo Seiyaku Co., Ltd.) | 2.00 parts |
| Glycerin | 9.90 parts |
| Magnesium nitrate | 0.50 part |
| Solution B | |
| n-Heptane | 19.90 parts |
| Epan-450 (block copolymer of polypropylene glycol with polyethylene glycol ether manufactured by Dai-Ichi Kogyo Seiyaku Co., Ltd.) | 2.00 parts |

The solution B was added dropwise and dispersed in the solution A with stirring and then emulsified through a homogenizer (manufactured by GAULIN) to provide a lithographic printing plate cleaner.

EXAMPLE 5

A printing plate cleaner was prepared in quite the same manner as that of Example 4, except that water-soluble soybean hemicellulose (c) was used instead of water-soluble soybean hemicellulose (a).

COMPARATIVE EXAMPLE 3

A printing plate cleaner was prepared in quite the same manner as that of Example 4, except that gum arabic was used instead of water-soluble soybean hemicellulose (a).

In order to effectively evaluate the effect of the printing plate cleaners prepared in the above examples and the comparative example, as with the printing plate used in the test for the image eraser, a positive-working photosensitive lithographic printing plate was prepared by the method described in Example 1 of Japanese Examined Patent Publication (Kokoku) No. 51-33444.

A part of the nonimage areas on the resultant printing plate was damaged by a needle, and oleic acid was rubbed into the damaged portion. Printing was carried out on 100 sheets, of a printing medium using the damaged printing plate. As a result, in all the prints, staining was observed on portions of the prints corresponding to the damaged portions of the printing plate. The damaged printing plate at its contaminated site was wiped with each printing plate cleaner, and printing was further carried out on 60,000 sheets of a printing medium to observe whether or not the contaminated site could be cleaned completely.

The results are summarized below.

| | Number of failed prints due to incomplete removal of contaminant regarding contaminated site wiped off with printing plate cleaner |
|---|---|
| Ex. 4 | 0 |
| Ex. 5 | 0 |
| Comp. Ex. 3 | 29 |

Thus, the printing plate cleaners using water-soluble hemicelluloses were excellent in emulsifiability, capability of removing contaminant in a hydrophilic region and capability of forming again the hydrophilic region.

EXAMPLE 6

| | |
|---|---|
| 30% Aqueous solution of water-soluble soybean hemicellulose (a) | 7.00 parts |
| Dimetylformamide | 46.00 parts |
| Cyclohexanone | 24.00 parts |
| Methoxycellulose | 2.00 parts |
| Nonionic surfactant* | 13.00 parts |
| 85% Phosphoric acid | 5.00 parts |
| Coloring dye (safranin) | 0.01 part |
| Finely divided silicic acid | 2.99 part |

*Polyoxyetylene/polyoxypropylene copolymer (manufactured by Asahi Denka Kogyo Ltd.)

The above-described ingredients were homogeneously mixed together to provide an image eraser for a lithographic printing plate.

EXAMPLE 7

An image eraser was prepared in the same manner as that of Example 6, except that water-soluble soybean hemicellulose (b) was used instead of water-soluble soybean hemicellulose (a).

EXAMPLE 8

An image eraser was prepared in the same manner as that of Example 6, except that water-soluble soybean hemicellulose (c) was used instead of water-soluble soybean hemicellulose (a).

COMPARATIVE EXAMPLE 4

An image eraser was prepared in the same manner as that of Example 6, except that gum arabic was used instead of water-soluble soybean hemicellulose (a).

In order to effectively evaluate the effect of the image erasers prepared in the above examples and the comparative example, a positive-working photosensitive lithographic printing plate was prepared by the method described in Example 1 of Japanese Examined Patent Publication (Kokoku) No. 51-33444.

Specifically, a mixture of a diazo oxide resin with a phenolic resin was coated as a photosensitive layer on a grained and anodized aluminum plate to provide a positive-working photosensitive lithographic printing plate. The printing plate was subjected to imagewise exposure through a halftone positive-working film and then developed with an alkaline developing solution to form an image on the printing plate. A suitable amount of each image eraser was then coated on a part of the image by a hair pencil, and the coating was allowed to stand for 2 min. Thereafter, the eraser wag washed away with running water, and the printing plate was dehydrated and gummed.

Printing was carried out on 30,000 sheets of a printing medium using the printing plate to observe whether the image portion coated with each image eraser did not receive the printing ink, that is, could successfully erase the unnecessary image completely.

The results are summarized below.

| | Number of failed prints due to incomplete removal of image regarding image area coated with image eraser |
|---|---|
| Ex. 6 | 5 |

-continued

| | Number of failed prints due to incomplete removal of image regarding image area coated with image eraser |
|---|---|
| Ex. 7 | 2 |
| Ex. 8 | 8 |
| Comp. Ex. 4 | 35 |

As is apparent from the foregoing description, the image erasers using water-soluble hemicelluloses were excellent in capability of preventing an image from remaining unremoved by washing and the stability in removal of an image.

Thus, it has been found that the image eraser for a lithographic printing plate using a water-soluble hemicellulose as the water-soluble polymer can be easily prepared by simply mixing ingredients together and coating of the image eraser on an image portion to be erased has excellent effects of preventing an image from remaining unremoved by washing and stably erasing the image.

EXAMPLE 9

| | |
|---|---|
| Pure water | 98.24 parts |
| Water-soluble soybean hemicellulose (a) | 0.20 part |
| Magnesium nitrate | 0.30 part |
| Phosphoric acid | 0.13 part |
| Monoammonium citrate | 0.13 part |
| Isopropyl alcohol | 1.00 part |

The above ingredients were mixed together to provide a dampening water composition for lithographic printing.

EXAMPLE 10

A dampening water composition was prepared in the same manner as that of Example 9, except that water-soluble soybean hemicellulose (b) was used instead of water-soluble soybean hemicellulose (a).

EXAMPLE 11

A dampening water composition was prepared in the same manner as that of Example 9, except that water-soluble soybean hemicellulose (C) was used instead of water-soluble soybean hemicellulose (a).

EXAMPLE 12

| | |
|---|---|
| Pure water | 98.980 parts |
| Water-soluble soybean hemicellulose (a) | 0.050 part |
| Disodium phosphate | 0.030 part |
| Monoammonium citrate | 0.020 part |
| 4-Isothiazolin-3-one compound | 0.002 part |
| Ethylene glycol monoisopropyl ether | 0.600 part |
| 1 to 4 mol ethylene oxide adduct of 2-ethyl-1,3-hexanediol | 0.300 part |
| Silicone resin | 0.018 part |

The above ingredients were mixed together to provide a dampening water composition for lithographic printing.

COMPARATIVE EXAMPLE 5

A dampening water composition was prepared in the same manner as that of Example 19, except that gum arabic was used instead of water-soluble soybean hemicellulose (a).

COMPARATIVE EXAMPLE 6

A dampening water composition was prepared in the same manner as that of Comparative Example 5, except that dextrin was used instead of gum arabic.

COMPARATIVE EXAMPLE 7

A dampening water composition was prepared in the same manner as that of Example 12, except that gum arabic was used instead of water-soluble soybean hemicellulose (a).

Each dampening water composition prepared in the above examples and comparative examples were set in an offset printing machine Hidel SORM manufactured by Heidel Insatsu K.K.) (a Carccior dampening arrangement).

Separately, FPS-2 (anodized multigrain type positive-working PS plate manufactured by Fuji Photo Film Co., Ltd.) as a lithographic printing plate was exposed and developed using a PS automatic developing machine 800E2, a positive developing solution DP-4 (manufactured by Fuji Photo Film Co., Ltd.) (diluted 8-fold with water) and a positive finisher FP (diluted twice with water) (manufactured by Fuji Photo Film Co., Ltd.) and then gummed. It was then mounted on the above-described printing machine, and dampening properties were evaluated in terms of the following items.

a. Contamination of Metering Roll

The degree of contamination of a water supply metering roll by deposition of an ink was examined and evaluated.

○: very small

Δ: Small

X: Significant b. Bleeding

Printing was carried out on 5000 to 10000 sheets of a printing medium using an ink (Apex G, Kurenai S; manufactured by Dainippon Ink and Chemicals, Inc.), and the operation of the printing machine was ceased to examine and evaluate the degree of bleeding of the ink of the image areas on the nonimage areas.

○: Not bled

Δ: Somewhat bled

X: Bled c. Emulsion Stability

When printing on 10000 sheets of a printing medium was completed, the state of emulsion of the ink on the ink mixing mill was examined and evaluated.

○: Good

Δ: Somewhat poor

X: Failed d. Continuous Printing Stability

Fresh water was used as dampening water to determine the amount of dampening water necessary to cause no contamination even when printing was carried out on 10000 sheets of a printing medium (necessary minimum amount of water supply). Then, printing was carried out using various types of dampening water in this necessary minimum amount to evaluate the continuous printing stability based on the number of prints which could be successfully obtained without staining of the print.

○: 10,000 sheets or more of a printing medium

Δ: 10,000 to 3,000 sheets of a printing medium

X: Less than 3,000 sheets of a printing medium

The results are summarized below.

| | Evaluation of properties of dampening water | | | |
|---|---|---|---|---|
| | a | b | c | d |
| Ex. 9 | ○ | ○ | ○ | ○ |
| Ex. 10 | ○ | ○ | ○ | ○ |
| Ex. 11 | ○ | ○ | ○ | ○ |
| Ex. 12 | ○ | ○ | ○ | ○ |
| Comp. Ex. 5 | ○ | ○ | Δ | ○ |
| Comp. Ex. 6 | ○ | ○ | Δ | Δ |
| Comp. Ex. 7 | ○ | ○ | Δ | ○ |

As described above, examination of the suitability of the dampening water compositions prepared in the examples of the present invention has revealed that all the dampening water compositions were excellent in prevention of contamination of the metering roll, prevention of bleeding, emulsion stability and continuous printing stability.

Thus, in the dampening water compositions for lithographic printing prepared using water-soluble hemicelluloses, a stock solution can be easily prepared by mixing the ingredients together, and what should be done for use of the dampening water composition is only to dilute the stock solution with tap water or well water. Further, the resultant diluted solution had excellent properties as the dampening water composition, such as prevention of contamination of the metering roll, prevention of bleeding, emulsion stability and continuous printing stability.

Industrial Applicability

The protective agent for Lithographic printing plate prepared by using a water-soluble hemicellulose as an assistant for a lithographic printing plate can be easily applied onto the plate by using a sponge, a cotton tampon, an automatic gum coater, etc., is excellent in both sensitization in image areas and desensitization in nonimage areas and can be easily removed by washing with water or contact with a dampening roller even after storage for a long period of time. Further, since the hydrophilicity in the nonimage areas and the lipophilicity in the image areas can be held, there is no possibility that the lithographic printing plate treated with the lithographic printing plate protective agent gives rise to printing dropout.

Further, in the image eraser for lithographic printing prepared by using a water-soluble hemicellulose as an assistant for a lithographic printing plate, a stock solution can be easily prepared by simply mixing the ingredients together, and coating of the eraser on an image portion to be erased has excellent effects of preventing occurrence of any residue that remains unremoved after washing and stably erasing the image.

Further, the dampening water composition for lithographic printing prepared by using a water-soluble hemicellulose exhibits excellent effects, such as prevention of contamination of the metering roll, prevention of bleeding, emulsion stability and continuous printing stability.

As is apparent from the foregoing description, the printing assistant comprising a water-soluble hemicellulose as an effective ingredient is superior to the conventional water-soluble polymers in properties such as film formability, long-terra storage stability, emulsifiability and desensitization in nonimage areas. Therefore, the present invention is very useful from the viewpoint of industry.

We claim:

1. A method of using a printing assistant for a lithographic printing plate, which comprises using 0.1 to 35% by weight water-soluble hemicellulose derived from soybean as a water-soluble polymer, the water-soluble hemicellulose not later insolubilized, and applying the printing assistant to the lithographic printing plate to protect nonimage areas of the lithographic printing plate.

2. The method of using a printing assistant for a lithographic printing plate according to claim 1 as a plate protective agent, which comprises combining the water-soluble hemicellulose, a surfactant from 0.01 to 10% by weight, and a wetting agent from 0.1 to 5% by weight in an acidic region, thereby forming an agent having a pH of 3 to 6.

3. The method of using a printing assistant for a lithographic printing plate according to claim 2 as a plate protective agent, which comprises applying the plate protective agent to the plate using an applicator, removing the plate protective agent by washing the plate with water, and contacting the plate with a dampening roller.

4. The method of using a printing assistant for a lithographic printing plate according to claim 2 as a plate protective agent, which comprises using a pH adjuster selected from the group consisting of a mineral acid, an organic acid, an inorganic acid, and an inorganic salt, thereby forming an agent having a pH of 3 to 6.

5. A method of using a printing assistant for a lithographic printing plate, which comprises using 0.1 to 5% by weight water-soluble hemicellulose derived from soybean as water-soluble polymer in an image eraser, the water-soluble hemicellulose not later insolubilized, and applying the printing assistant to the lithographic printing plate as the image eraser.

6. The method of using a printing assistant for a lithographic printing plate according to claim 5 in an image eraser, which comprises combining the water-soluble hemicellulose, an organic solvent in the range of 50 to 90% by weight, and a surfactant from 3 to 20% by weight in an acidic region, thereby forming an image eraser having a pH of 3 to 6.

7. The method of using a printing assistant for a lithographic printing plate according to claim 6 in an image eraser, which comprises using a pH adjuster selected from the group consisting of a mineral acid, an organic acid, an inorganic acid, and an inorganic salt.

8. The method of using a printing assistant for a lithographic printing plate according to claim 6 in an image eraser, which comprises coating the eraser on an image portion of the lithographic printing plate, washing the image portion, removing residue from the plate, and erasing the image portion.

9. A method of using a printing assistant for a lithographic printing plate, which comprises using 0.001 to 10% by weight water-soluble hemicellulose derived from soybean as water-soluble polymer in a dampening water composition, the water-soluble hemicellulose not later insolubilized, and applying the printing assistant to the lithographic printing plate as the dampening water composition.

10. The method of using a printing assistant for a lithographic printing plate according to claim 9 in a dampening water composition, which comprises combining the water-soluble hemicellulose, a pH buffering substance in the range from 0.001 to 1% by weight, an organic solvent in the range of 50 to 90% by weight, a surfactant from 3 to 20% by weight, and a wetting agent in the range of 0.03 to 5% by weight.

11. The method of using a printing assistant for a lithographic printing plate according to claim 10 in a dampening water composition, which comprises further adding a preservative in the range of 0.001 to 1% and an anti-foaming agent in the range of 0.001 to 3% by weight, thereby protecting against microorganisms and preventing foaming.

* * * * *

UNITED STATES PATENT AND TRADEMARK OFFICE

CERTIFICATE OF CORRECTION

PATENT NO. : 5,615,613

DATED : April 1, 1997

INVENTOR(S) : Hattori et al.

It is certified that error appears in the above-indentified patent and that said Letters Patent is hereby corrected as shown below:

Column 2, line 26, "in" should be --In--.

Column 3, line 46, delete [iokara] and insert --(okara--.

Column 4, line 13, after "jellan gum" insert --,--.

Column 5, line 63, after "the" delete [.].

Column 15, line 20, delete [Carccior] and insert --Carcolor--.

Column 17, delete line 7, delete [terra] and insert --term--.

Signed and Sealed this

Twenty-eighth Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,615,613

DATED : April 1, 1997

INVENTOR(S) : Hattori et al.

It is certified that error appears in the above-indentified patent and that said Letters Patent is hereby corrected as shown below:

Column 7, line 15, "abletic" should be —abietic—.

Signed and Sealed this

Second Day of December, 1997

*Attest:*

*Attesting Officer*

BRUCE LEHMAN

*Commissioner of Patents and Trademarks*